US006273277B1

(12) United States Patent
Geldenhuys

(10) Patent No.: US 6,273,277 B1
(45) Date of Patent: Aug. 14, 2001

(54) ROTATING IMPLEMENT STORAGE DEVICE

(76) Inventor: Walter G. Geldenhuys, 7895 E. Jefferson Pl., Denver, CO (US) 80237

( * ) Notice: Subject to any disclaimer, the term of this patent is extended or adjusted under 35 U.S.C. 154(b) by 0 days.

(21) Appl. No.: 09/522,491

(22) Filed: Mar. 10, 2000

(51) Int. Cl.[7] ..... A47F 5/00

(52) U.S. Cl. ..... 211/70; 211/70.6; 211/95; 211/115

(58) Field of Search ..... 211/95, 163, 70.6, 211/70, 99, 100, 59.1, 115

(56) References Cited

U.S. PATENT DOCUMENTS

| | | | | |
|---|---|---|---|---|
| 321,624 | * | 7/1885 | McPherson | 211/115 X |
| 722,614 | | 3/1903 | Johnson . | |
| 739,275 | | 9/1903 | Abbe . | |
| 976,205 | * | 11/1910 | Neuhaus . | |
| 1,078,729 | * | 11/1913 | Hill . | |
| 1,242,305 | | 10/1917 | Arey . | |
| 1,864,039 | | 6/1932 | Brownson . | |
| 2,506,467 | | 5/1950 | Ragland . | |
| 2,639,820 | | 5/1953 | Lee . | |
| 3,314,177 | * | 4/1967 | Mies et al. | 211/115 X |
| 4,809,644 | | 3/1989 | Wells . | |
| 4,936,565 | * | 6/1990 | Fredrickson | 211/59.1 |
| 5,462,178 | * | 10/1995 | Wallach et al. | 211/95 |

FOREIGN PATENT DOCUMENTS

| | | |
|---|---|---|
| 17141 | 8/1882 | (GB) . |
| 19042 | 8/1882 | (GB) . |
| 757245 | 9/1956 | (GB) . |

OTHER PUBLICATIONS

Popular Mechanics Magazine, vol. 109, No. 3, Mar. 1958.*

* cited by examiner

*Primary Examiner*—Robert W. Gibson, Jr.
(74) *Attorney, Agent, or Firm*—Lee G. Meyer; Snell & Wilmer LLP

(57) ABSTRACT

The present invention provides a rotating implement storage device to store garden implements and similar tools in garages, tool sheds, or like storage facilities where storage space has traditionally been linear along a wall. The device of the present invention permits more efficient use of limited storage space by providing a suspended, rotating carousel attached to a mounting bracket having a plurality of retaining hooks or brackets about the periphery of the carousel upon which a variety of implements are retained. Preferably, the device is mounted to a solid support and has a swivelling S-shaped rigid shaft from which the rotating storage carousel is suspended thereby allowing the carousel to rotate freely and providing for improved storage of various implements as well as improved accessability to those implements.

11 Claims, 3 Drawing Sheets

ROTATING IMPLEMENT STORAGE DEVICE

BACKGROUND OF THE INVENTION

1. Field of The Invention

The present invention relates to implement storage devices; and, more particularly, to rotatable implement storage devices for storing garden implements and the like.

2. Description of Related Art

In modern American suburbia, the garage has become the storage receptacle for a myriad of items that are necessary for work and recreation. The need for this storage space has become so acute that many suburban dwellings contain a 3-car garage even though the occupants own only two vehicles. In many instances, a recreational vehicle, such as a boat or a 4-wheel drive occupies the third bay; but in most cases, it is utilized for storage and as a work area. Items such as bicycles, sports equipment, garden furniture, wheelbarrows, trash cans, and work shops containing wrenches, power tools, and other implements for repairing various electrical and/or mechanical apparatuses, throughout the house, are generally stored in the garage.

Gardening has become a recreational pastime of suburbia, and the lawns and gardens of the occupants of suburban dwellings have become a source of pride and even, in some cases, competition. For example, automatic-timed sprinkler systems assure vigilant watering of both shrubbery and lawn, and many commercial services provide lawn fertilization, weed control, aeration, and the like. Traditionally, the implements for gardening, which can include very intricate devices, have been stored in the garage or, in some cases, a tool shed. Hand implements, such as rakes, hoes, shovels, picks, and the like, traditionally have been stored either in a corner of the garage or hung linearly along the wall on hooks, nails, clips or the like. Many implement handles contain a hole or other attachment means which allows the implement to be secured to these nails or hooks.

Unfortunately, the space utilization of these lineal storage methods is not optimum, and valuable space in an already crowded garage or tool shed that could be used for other purposes is wasted. Moreover, in order to access the tools stored lineally on the wall, one must approach the tools directly beneath their placement on the wall, often necessitating that items beneath the stored tools be moved or vehicles backed from the garage in an effort to facilitate access to the desired tools.

Various methods for storing items have been proposed in the prior art. For example, U.S. Pat. No. 1,864,039 issued to DeWitt M. Brownson, Jun. 21, 1932, shows a utensil holder mounted horizontally to a bracket on a kitchen wall adjacent to a stove or range for hanging kitchen utensils, such as knives, forks, spoons, or ladles, which are used daily in connection with culinary work. In one embodiment, a rotatable disk is provided wherein the periphery is formed with radial notches or grooves to receive hooks or nails which are driven into the free end of the handles of the utensils so that the latter may depend from the circular formation of the disk. While this device provides for the storage of small implements in a relatively small space on a disk, the implement itself must be configured with some kind of hook or retention device to depend from the rack. Additionally, this utensil holder would not be applicable for retaining or holding large implements such as rakes, hoes, shovels, or the like.

U.S. Pat. No. 4,809,644 issued to Joseph A. Weld, Jr. on Mar. 7, 1989, shows a circular rack much like a pie rack with hooks and tongs upon which bridles and other equestrian gear are laid so that they may be rotatably brought into view. Again, this would be inappropriate for a garden implement-retaining device. Likewise, there are a myriad of references for circular tie racks, both motorized and unmotorized, which allow ties to be draped over hooks on a wheel or disk which can be rotated from its center in order to bring the ties into view. Again, the configuration would not be operable with regard to large garden implements, and the method of retaining the ties is to lay the tie or garment over a hook such as bathroom hook on a door or the like.

Therefore, it would be advantageous to have a rack or device which allowed ease of accessibility to large tools, such as gardening implements, while maximizing the use of comparatively minimal amounts of space It would also be advantageous to have a storage means that could be mounted directly to the ceiling or the walls, thereby allowing effective use of available space while removing garden implements from the floor space of the garage or tool shed. Finally, it would be advantageous to have an implement storage device wherein the means for attaching or storing the implement allowed accessibility from a station not directly proximate the wall where other items are stored as well as permitting ease of implement retrieval by a single movement of the wrist. This last characteristic is an especially important consideration for elderly people.

SUMMARY OF THE INVENTION

A garden implement storage device has now been discovered that overcomes the above-described deficiencies of the prior art. The present invention provides an implement storage device that permits improved accessibility to stored garden implements and tools while maximizing available storage space. In accordance with the invention, the apparatus comprises a solid support-mourited rotating implement rack having releasable means for hanging, retaining, and storing garden tools, other large implements, or the like.

The rotating implement storage device of the instant invention comprises mounting bracket means adapted for mounting or suspending the device from a solid support, such as a wall or a ceiling in a garage, tool shed, or like storage facility; a carousel having at least one set of retention means for retaining an implement; and a support shaft having a first end and a second end with the first end adapted for supporting attachment to the mounting bracket means and the second end rotatably attached to the carousel. Preferably, at least a portion of the retention means is peripherally mounted on the carousel.

The mounting bracket means is preferably a U-channel, having at least two holes or openings passing there through, in spaced apart relation along the length of the U-channel, into which fasteners are inserted for mounting the U-channel onto a solid support. The mounting bracket means also can be a bar, which can be either solid or hollow, or a plate. The fasteners include screws, toggle bolts, or any other suitable means for attaching a mounting bracket to a solid support, as known and practiced by those skilled in the art. The mounting bracket means can be made of a wide variety of rigid materials, such as, for example, wood, plastics, metals, composites, fiberglass, or any other suitable material known and used by those skilled in the art.

In an alternate embodiment of the instant invention, the mounting bracket means further comprises implement retaining means for retaining and supporting implements or tools.

In accordance with the invention, the support shaft may be of any configuration that allows the carousel to rotate freely while supporting the various implements or tools stored thereon and while permitting a person to reach any and all of those implements conveniently. Such configurations would include an S-shaped support shaft and an L-bracket that is bent at a substantially right angle, making an L-shaped, rigid shaft. In another aspect, when the device is mounted onto a solid support, such as a ceiling, the support shaft is a straight, unbent shaft having a first end and a second end opposite the first. In this preferred aspect, the long axis of the shaft is aligned substantially perpendicular to the long axis of the mounting bracket means.

In a preferred embodiment, the rotating implement storage device further comprises support shaft attachment means fixedly attached to the mounting bracket means, preferably comprising a pair of parallel, spaced apart retaining brackets, having aligned apertures in each, to allow a pin or swivel to pass there through for swiveling the support shaft and the rotatably attached carousel from a fixed, user-accessible position to a storage position. The support shaft is attached to the support shaft attachment means proximate to the first end of the shaft by any known means for attaching a support shaft to a support shaft attachment means, including screws, bolts, pins, or the like inserted through apertures in the shaft and the aligned apertures in the support shaft attachment means. The carousel is rotatably attached to the second end of the support shaft. The support shaft, whether straight, S-shaped, or L-shaped, may be solid or hollow and can be made from a wide variety of rigid materials, including wood, composites, plastics, metals, or the like. In a preferred aspect, the shaft is made of steel.

In accordance with the invention, the carousel includes a hub or center portion, rotatably attached to the second end of the support shaft, which permits rotary motion of the carousel relative to the stationary support shaft. Preferably, the carousel is of a circular shape having a rim around the periphery, spokes disposed across the interior of the carousel to provide rigidness and support; and a plurality of radially or outwardly extending implement retaining means fixedly attached around the rim of the carousel for releasably retaining and supporting the implements suspended thereon. In another embodiment, a plurality of radially or outwardly extending implement retaining means are fixedly attached along the length of the spokes for releasably retaining and supporting the implements placed thereon. The implement retaining means may include brackets, hooks, friction grips, or any other hardware capable of removably supporting garden implements and tools and of being peripherally attached to the rim of the carousel and/or fixedly attached along the length of the spokes. The carousel can be of any shape or design, such as, for example, a circle, disc, square, rectangle, triangle, diamond, oval, or the like, that allows implements to be hung and stored on implement retaining means disposed around the periphery of the carousel and/or along the length of the spokes. For illustrative purposes only, the carousel is discussed herein with reference to a circular design.

In order for the carousel to rotate freely on the end of the support shaft, a bearing assembly is used. The bearing assemblies that can be utilized are known in the art. For example a sleeve bearing, a ball bearing, and the like. In a preferred embodiment, the support shaft is S-shaped to allow clearance for the carousel to rotate when the rack is mounted flush to a wall.

The rotatable implement storage device can be made of wood, metal, plastics, fiberglass, or any other suitable rigid and durable material but is preferably made of steel. The dimensions of the rotatable implement storage rack may be of any suitable size. The mounting bracket means is preferably between about 26 inches and about 60 inches long, with 32 inches being preferred. The support shaft preferably has an overall length of between about 15 inches and 36 inches, and preferably 22 inches long. The carousel preferably has a diameter of between about 10 and about 25 inches, but in a preferred embodiment the carousel is about 20 inches in diameter.

Other objects, features, and advantages of the present invention will become apparent to those skilled in the art from the following detailed description. It should be understood, however, that the detailed description and specific examples, while indicating preferred embodiments of the present invention, are given for purposes of illustration and not of limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more fully understood from the detailed description to follow, with reference being made to the accompanying drawings in which like reference numerals represent like parts throughout and in which.

DETAILED DESCRIPTION OF THE PREFERRED EMBODIMENTS

Figure 1:
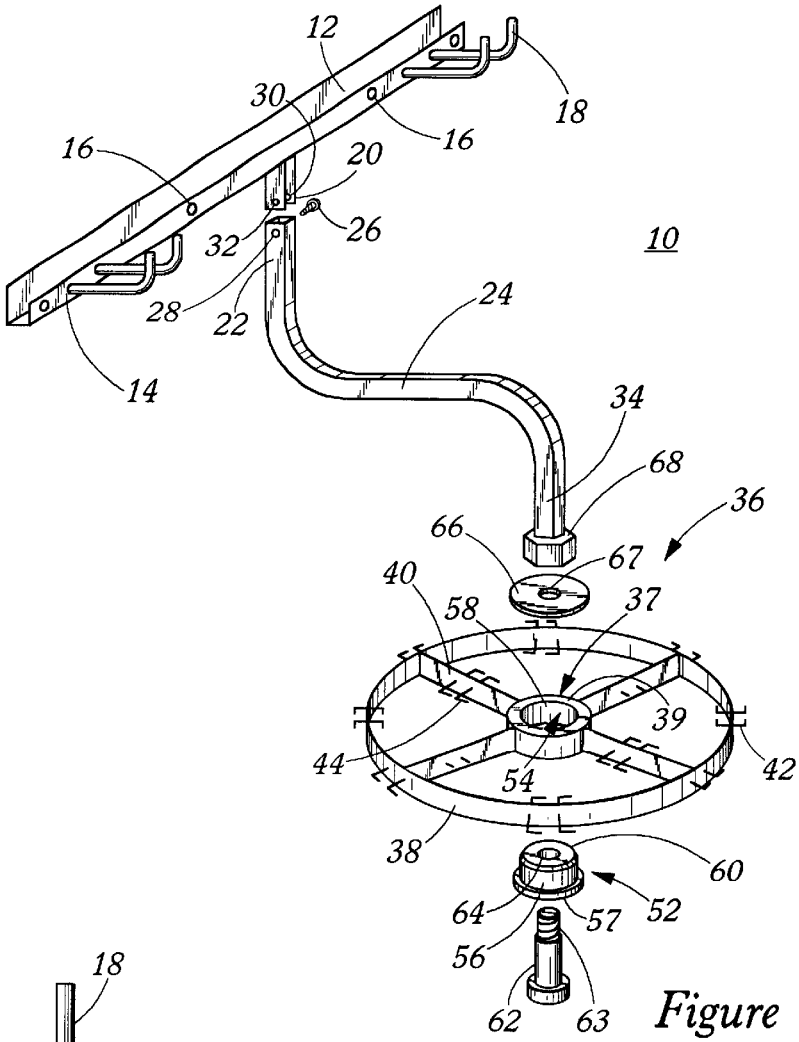
FIG. 1 is an exploded view of a preferred embodiment of the implement storage device of the instant invention.
Figure 2:
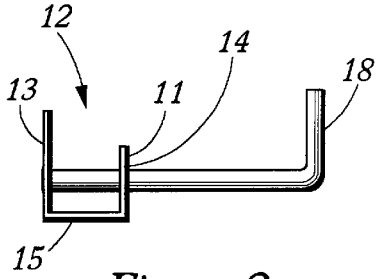
FIG. 2 is a side view of the preferred mounting bracket means of the instant invention as shown in FIG. 1.

Turning to the drawings, FIG. 1 is an exploded view of a preferred embodiment of the rotating implement storage device 10 of the instant invention. In accordance with the invention, the device 10 comprises a mounting bracket means 12, which can be mounted on or suspended from a solid support, such as, for example, a wall or a ceiling of a garage, tool shed, or other storage facility. As better shown in FIG. 2, the preferred mounting bracket means 12 of the instant invention comprises a U-channel having a front side 11, a back side 13 opposite the front side 11, and an under side 15 fixedly attached to and connecting both the front side 11 and the back side 13. The back side 13 is substantially longer than the front side 11 and is positioned to fixedly attach to a solid support (not shown). In a preferred embodiment, at least one implement retaining means 18 such as a hook, bracket, or friction grip is fixedly attached in spaced apart relation to the mounting bracket means 12 for hanging and storing garden implements or similar tools thereupon. The implement retaining means 18 is fastened to mounting bracket means 12 by inserting the implement retaining means 18 through opening 14 as shown in FIG. 2. The mounting bracket means 12 is attached to a solid support by means of at least two holes or openings 16 placed in spaced apart relation along the length of the mounting bracket means 12 and running through the back side 13 and the front side 11 into which fasteners are inserted for fixedly attaching mounting bracket means 12 to the solid support. The fasteners (not shown) may include screws, nails, or any other suitable means known in the art.

A support shaft attachment means 20, comprising a pair of holding brackets having opposing, aligned apertures 30 and 32 to accept a fastener, is fixedly attached perpendicular to and proximate the center of mounting bracket means 12. The first end 22 of support shaft 24, containing a mounting hole 28 there through, slidably inserts into the holding brackets 20 in order to attach the support shaft 24 to the mounting bracket means 12. A suitable fastening means 26 is then inserted through the hole 30 in the holding brackets 20 through hole 28 in support shaft 24 and then out through opening 32.

In a preferred embodiment, the support shaft attachment means 20 is a pair of holding brackets which allows support shaft 24 to rotate about fastener 26. Thus, the pair of holding brackets 20 attaches to mounting bracket means 12 in a manner to allow support shaft 24 to rotate and swivel with respect to the mounting bracket means 12, thereby permitting the support shaft 24 and the suspended carousel 36 to swivel and move from a fixed user-accessible position to another fixed storage position when the device is empty.

Figure 3:
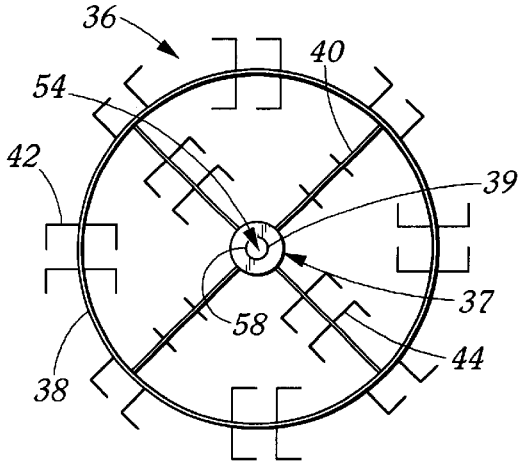
FIG. 3 is a top view of the carousel shown in FIG. 1.

Referring now to FIG. 3, there is shown a top view of a preferred embodiment of the carousel 36 of the instant invention. The carousel 36 contains a hub 37 having a hub surface 39. The hub 37 is rotatably attached to the second end 34 of support shaft 24, permitting rotary motion of the carousel 36 relative to the support shaft 24. In a preferred embodiment, the carousel 36 is of a circular shape having a rim 38 around the periphery, spokes 40 disposed across the diameter or interior length of carousel 36 to provide rigidness and support, and a plurality of radially or outwardly extending implement retaining means 42 fixedly attached around the rim 38 of the carousel 36 for releasably retaining and supporting the implements placed thereon. In another embodiment, a plurality of radially or outwardly extending implement retaining means 44 are fixedly attached along the length of the spokes 40 for releasably retaining and supporting a variety of implements or tools placed thereon. The implement retaining means 42 and 44 may include brackets, hooks, friction grips, or any other hardware capable of removably supporting garden implements and tools. The carousel 36 is preferably made of metal, though it can be made of any suitably rigid and durable material, such as, for example, wood, fiberglass, or plastic.

Figure 4:
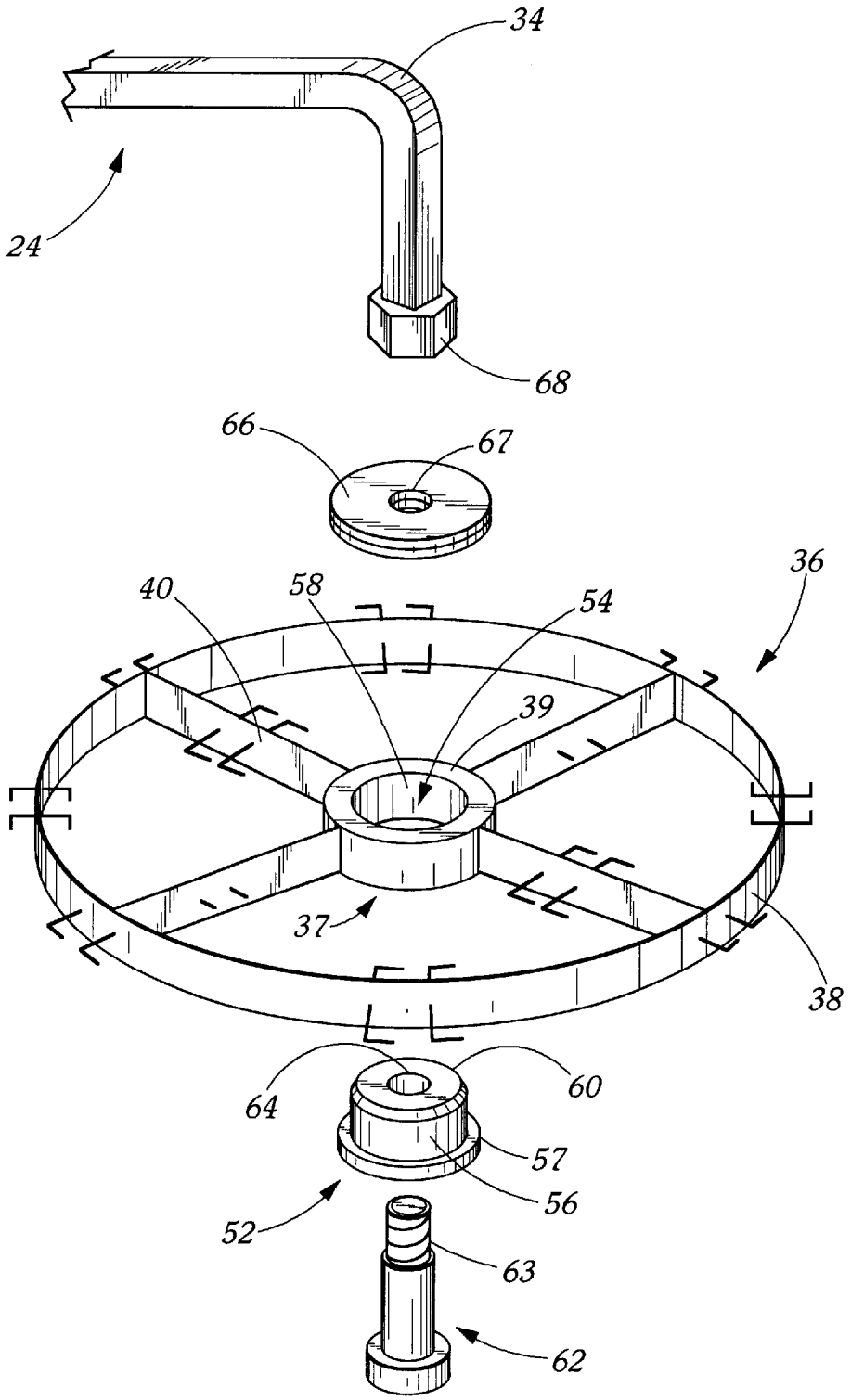
FIG. 4 is a detailed exploded view of certain components of the carousel shown in FIG. 1.

As seen in FIG. 1, the carousel is rotatably mounted on the second end 34 of support shaft 24 by means of a bolt 62. As better seen in FIG. 4, a sleeve bearing 52, having an outer race 56 with a diameter slightly less than the inner diameter of the inner race 58 of the center mounting aperture 54 and load bearing shoulder 57 having a diameter greater than the inner diameter of the inner race 58 of the center mounting aperture 54, is inserted into the center mounting aperture 54 with the outer race 56 of the bearing 52 contacting the inner race 58 of the center mounting aperture 54 and the surface 60 substantially flush with the upper surface of the hub 37. The lower surface of hub 37 rests on the load bearing shoulder 57. Threaded bolt 62, which is disposed beneath the bearing 52, extends through the bearing center opening 64, the center mounting aperture 54, the center aperture 67 of spacer washers 66, and then into the threaded portion(not shown) of nut 68 retained on the second end 34 of support shaft 24. The threaded bolt 62 is tightened such that bolt threads 63 engage the threaded portion of nut 68 in a conventional manner. A secure assembly is provided wherein the carousel 36 rotates freely about the stationary support shaft 24. Thus, particular garden implements or tools placed on the implement retaining means 42 and 44, such as brackets, hooks, or friction grips, are easily located by rotating the carousel 36 until the desired tool is in view and readily accessible.

When the device 10 is mounted onto a solid self-standing support, such as a wall, the support shaft 24 is preferably an S-shaped, rigid shaft. As shown in FIG. 1, a first end 22 of the support shaft is substantially perpendicular to the mounting bracket means 12; a middle section is at a substantially right angle to the first end 22; and a second end 34 is substantially parallel to the first end 22 and at a substantially right angle to the middle section.

Figure 5:
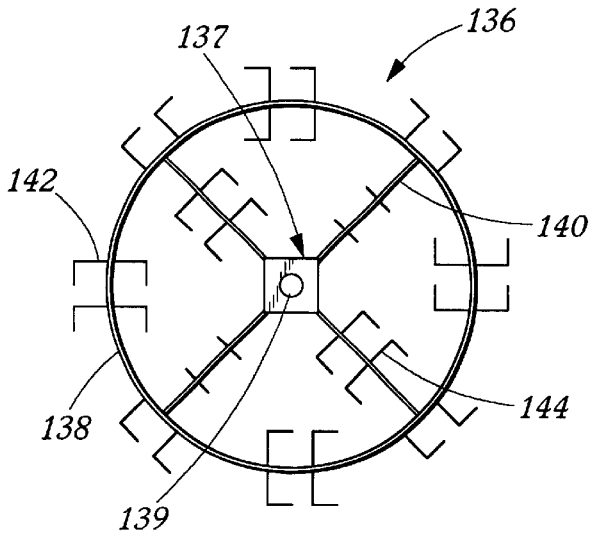
FIG. 5 is top view of another embodiment of the carousel of the instant invention shown in FIG. 6.
Figure 6:
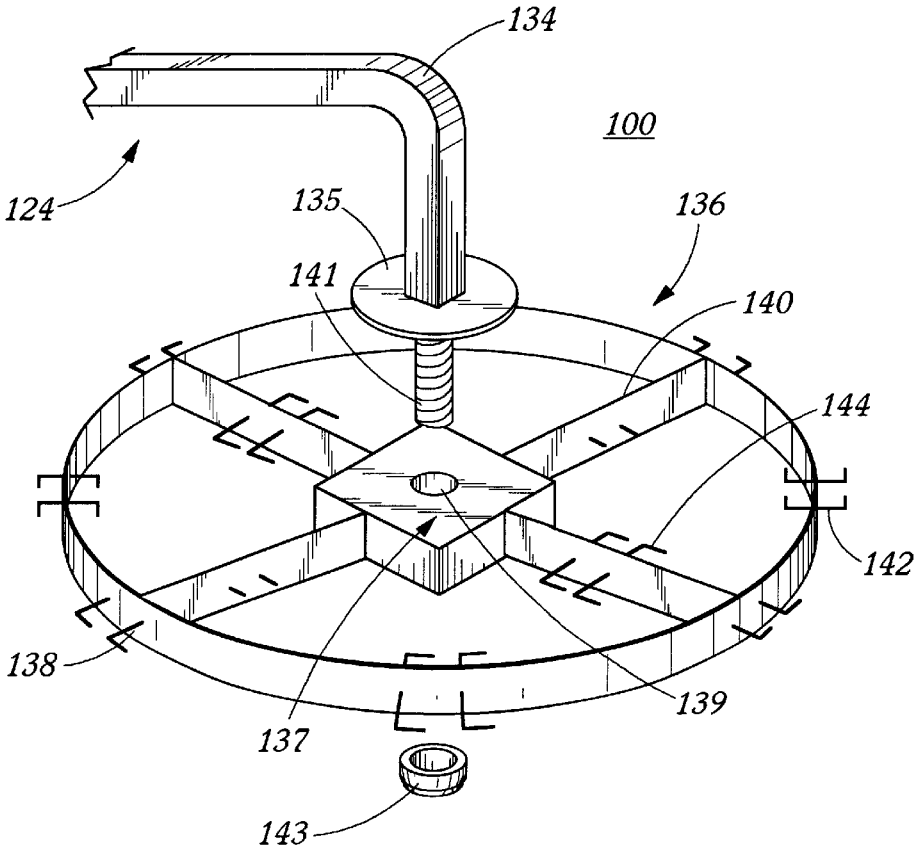
FIG. 6 is an exploded view of another embodiment of the rotatable attachment of the carousel.

Another embodiment of the instant rotating implement storage device 100 comprising alternate means for rotatably attaching the carousel 136 to the support shaft 124 is shown in FIG. 6. As better seen in FIG. 5, the carousel 136 is of a circular shape having a substantially square hub 137, a rim 138 around the periphery, spokes 140 disposed across the diameter or interior length of carousel 136 to provide rigidness and support, and a plurality of radially or outwardly extending implement retaining means 142 fixedly attached around the rim 138 of the carousel 136 for releasably retaining and supporting the implements placed thereon. A plurality of radially or outwardly extending implement retaining means 144 are fixedly attached along the length of the spokes 140 for releasably retaining and supporting a variety of implements or tools placed thereon. The implement retaining means 142 may include brackets, hooks, friction grips, or any other hardware capable of removably supporting garden implements and tools. The carousel 136 is preferably made of metal, though it can be made of any suitably rigid and durable material, such as, for example, wood, fiberglass, or plastic.

As better seen in FIG. 6, the substantially square hub 137 of carousel 136 is rotatably attached to the second end 134 of support shaft 124, permitting rotary motion of the carousel 136 relative to the support shaft 124. The second end 134 of support shaft 124 has a male threaded member 141 which descends vertically from the second end 134. Proximate the upper portion of the male threaded member 141, and disposed about the second end 134 and fixedly attached thereto is washer or plate 135. The male threaded member 141 is inserted through the mounting aperture 139 in the hub 137 and into a threaded locknut 143. The bearing surface between washer 135 and hub 137 is lubricated with any suitable, commercially available lubricant, such as, for example, graphite, grease, or oil. The load bearing surface of locknut 143 is likewise lubricated. Thus, particular garden implements or tools placed on the implement retaining means 142 and 144, such as brackets, hooks, or friction grips, are easily located by rotating the carousel 136 until the desired tool is in view and readily accessible.

It will be realized that the rotatable implement storage rack 10 can be made of wood, metal, plastics, fiberglass, or any other suitable rigid and durable material, but it is preferably made of steel. It also will be realized by the skilled artisan that a plurality of spaced apart support shafts each having a rotatable carousel can be suspended from a single mounting bracket to increase storage capacity. The preferred dimensions of the rotatable implement storage rack 10 may be of any suitable size. The mounting bracket means 12 is preferably between about 26 inches and about 60 inches long, with 32 inches being preferred. The support shaft 24 preferably has an overall length of between about 15 inches and 36 inches but is preferably 22 inches long. The carousel 36 preferably has a diameter of between about 10 inches and about 25 inches, but in a preferred embodiment the carousel 36 is about 20 inches in diameter.

Although the present invention has been described with reference to preferred embodiments, including particular materials and size parameters, those skilled in the art will recognize that various modifications and variations to the same can be accomplished without departing from the spirit and scope of the present invention and that such modifications are clearly contemplated herein. No limitation with respect to the specific embodiments disclosed herein is intended nor should any be inferred.

What is claimed is:

1. A rotating implement storage device comprising:

a. a mounting bracket for attaching to a solid support;

b. a support shaft having a first end attached to said mounting bracket and a second end;

c. a carousel rotatably attached to said second end of said support shaft; and, d. a first implement retainer attached to said carousel for hanging and storing implements, wherein said mounting bracket includes at least a second implement retainer fixedly attached to said mounting bracket.

2. The device of claim 1 wherein said second implement retainer is selected from the group consisting of brackets, hooks, and function grips.

3. The device of claim 1 wherein said first implement retainer is selected from the group consisting of brackets, hooks, and friction grips.

4. A rotating implement storage device comprising:

a. a mounting bracket for attaching to a solid support;

b. a support shaft having a first end attached to said mounting bracket, a middle section, and a second end;

c. a carousel rotatably attached to said second end; and, d. at least one implement retainer attached to said carousel for hanging and storing implements, wherein said support shaft comprises a rigid, S-shaped shaft, said first end is substantially perpendicular to said mounting bracket, said middle section is at a substantially right angle to said first end, and said second end is substantially parallel to said first end and at a substantially right angle to said middle section.

5. A rotating implement storage device comprising:

a. a mounting bracket for attaching to a solid support;

b. a support shaft having a first end attached to said mounting bracket and a second end;

c. a carousel rotatably attached to said second end of said support shaft; and, d. at least one first implement retainer attached to said carousel for hanging and storing implements, wherein said carousel includes a rim forming a circular periphery, a hub, and a plurality of spokes connecting said hub to said rim, and wherein said plurality of spokes includes at least one second implement retainer fixedly attached along the length of said spokes for hanging and storing implements.

6. The device of claim 5 wherein said at least one second implement retainer is selected from the group consisting of brackets, hooks, and friction grips.

7. The device of claim 5 wherein said at least one first implement retainer is selected from the group consisting of brackets, hooks, and friction grips.

8. A rotating implement storage device comprising:

a. a mounting bracket for attaching said device to a solid support;

b. a support shaft attachmnent means fixedly attached to said mounting bracket for swivelly attaching a support shaft;

c. a Support shaft having a first end and a second end, wherein said first end is swivelly attached to said support shaft attachment means, d. a carousel rotatably attached to said second end of said support shaft and further comprising:

i. a hub disposed at a center of said carousel for rotatably attaching said carousel to said second end of said support shaft;

ii. a rim around a periphery of said carousel having at least one first implement retainer fixedly attached around said rim and radially extending from said rim; and iii. a plurality of spokes disposed across an interior length of said carousel connecting said hub to said rim, wherein said mounting bracket further comprises a plurality of second implement retainers, and wherein said second implement retainers are in spaced apart relation and fixedly attached along the length of said mounting bracket.

9. A rotating implement storage device comprising:

a. a mounting bracket for attaching said device to a solid support;

b. a support shaft attachment means fixedly attached to said mounting bracket for swivelly attaching a support shaft;

c. a support shaft having a first end and a second end, wherein said first end is swivelly attached to said support shaft attachment means;

d. a carousel attached to said second end of said support shaft comprising:

i. a hub disposed at a center of said carousel for rotatably attaching said carousel to said second end of said support shaft;

ii. a rim around a periphery of said carousel having at least one first implement retainer fixedly attached around said rim and radially extending from said rim; and iii. a plurality of spokes disposed across an interior length of said carousel connecting said hub to said rim, wherein said plurality of spokes further comprises at least one second implement retainer fixedly attached along the length of said spokes for hanging and storing a variety of implements.

10. The device of claim 9 wherein said second implement retainer is selected from the group consisting of brackets, hooks, and friction grips.

11. The device of claim 9 wherein said first implement retainer is selected from the group consisting of brackets, hooks, and friction grips.

* * * * *